US009149941B2

(12) United States Patent
Ho

(10) Patent No.: US 9,149,941 B2
(45) Date of Patent: Oct. 6, 2015

(54) BLADE-SWITCHABLE UTILITY KNIFE

(71) Applicant: Chun-Feng Ho, Taichung (TW)

(72) Inventor: Chun-Feng Ho, Taichung (TW)

( * ) Notice: Subject to any disclaimer, the term of this patent is extended or adjusted under 35 U.S.C. 154(b) by 237 days.

(21) Appl. No.: 13/964,076

(22) Filed: Aug. 10, 2013

(65) Prior Publication Data

US 2014/0053408 A1 Feb. 27, 2014

(30) Foreign Application Priority Data

Aug. 22, 2012 (TW) ..... 101216152 U

(51) Int. Cl.
*B26B 1/08* (2006.01)
*B26B 27/00* (2006.01)
*B26B 5/00* (2006.01)

(52) U.S. Cl.
CPC . *B26B 1/08* (2013.01); *B26B 5/001* (2013.01); *B26B 27/005* (2013.01)

(58) Field of Classification Search
CPC ..... B26B 1/08; B26B 27/005; B26B 5/001; B26B 3/04
USPC ..... 30/2, 152
See application file for complete search history.

(56) References Cited

U.S. PATENT DOCUMENTS

| | | | | |
|---|---|---|---|---|
| 6,735,872 | B1 * | 5/2004 | Chang | 30/162 |
| 7,107,688 | B1 * | 9/2006 | Critelli et al. | 30/162 |
| 7,155,829 | B1 * | 1/2007 | Sun | 30/162 |
| 8,201,336 | B2 * | 6/2012 | De | 30/162 |
| 8,695,221 | B2 * | 4/2014 | Hao | 30/151 |
| 2002/0029480 | A1 * | 3/2002 | Lin | 30/125 |
| 2006/0080842 | A1 * | 4/2006 | Schmidt | 30/162 |
| 2010/0180449 | A1 * | 7/2010 | Van Deursen | 30/162 |
| 2011/0308090 | A1 * | 12/2011 | Ho | 30/152 |
| 2014/0053408 | A1 * | 2/2014 | Ho | 30/152 |
| 2015/0082641 | A1 * | 3/2015 | Wang | 30/304 |

* cited by examiner

*Primary Examiner* — Sean Michalski
(74) *Attorney, Agent, or Firm* — Cheng-Ju Chiang

(57) ABSTRACT

The present invention relates to an improved blade-switchable utility knife. The utility knife comprises a housing, a blade slider, a slide actuator, a switch actuator, and a pair of blades. By switching the switch actuator, a corresponding blade is pushed and pressed by either a first auxiliary reacting portion or a second auxiliary reacting portion to remain in an operative position thereof, and is moved together with the blade slider. Accordingly, the present invention has advantages and effects of quick switch of blades for use and convenient carrying, etc.

5 Claims, 12 Drawing Sheets

BLADE-SWITCHABLE UTILITY KNIFE

CROSS REFERENCE TO RELATED APPLICATIONS

The present application is a continuation-in-part of a U.S. patent application Ser. No. 13/345,656, filed on Jan. 6, 2012, which is a continuation-in-part of a U.S. patent application Ser. No. 13/161,405, filed on Jun. 15, 2011, now U.S. Pat. No. 8,484,854, the disclosure of which is incorporated by reference herein.

TECHNICAL FIELD

The present invention relates to an improved blade-switchable utility knife, and particularly to an improved blade-switchable utility knife capable of switching blade in use, and having advantages and effects of quickly switching blades for use and carrying conveniently, etc.

DESCRIPTION OF BACKGROUND

Conventional utility knifes are generally designed to fix a blade onto a blade sliding seat so as to allow the blade to be extendable out of a shell of the utility knife or retractable back in the shell via moving of the blade sliding seat.

However, conventional utility knifes can only be equipped with one blade for use. When the blade in use becomes worn out and dull during its use process or different blades are required for use, it is necessary to firstly dismantle the originally installed blade from the blade sliding seat and replace it with another blade. It is rather inconvenient for use.

Furthermore, it is rather inconvenient and time-consuming to replace different blades in the abovementioned way when continuously and alternately using different types of blades is necessary for accomplishment of any particular work content. Generally speaking, under such circumstances, two or more utility knifes are prepared to perform such work content for the sake of saving time. However, such working manner further causes problems of inconvenient carrying and being costly, etc.

Accordingly, it is necessary to invent improved products to overcome the above-mentioned shortcomings and problems.

SUMMARY

An object of the present invention is to provide an improved blade-switchable utility knife having advantages and effects of quick switch of blades for use and convenient carrying, etc. The present invention can solve drawbacks of inconvenient use of conventional utility knifes equipped with only one blade for use.

To solve the above the above mentioned problems, the present invention provides an improved blade-switchable utility knife to comprise the following.

A housing defines an internal space therein, an opening, a sliding slot, a switch channel, a pair of first limit portions and a pair of second limit portions.

A blade slider is received in the internal space of the housing to slidably move backwards and forwards within the internal space and to move to at least a blade retraction position and a blade protrusion position. The blade slider comprises a first blade compartment and a second blade compartment. A fixing bulge is formed in each of the first and second blade compartments.

A slide actuator is fixedly disposed on the blade slider, and is installed and slidably movable in the sliding slot.

A switch actuator is slidably installed in the switch channel and comprises a push portion, a follower portion, a first auxiliary reacting portion and a second auxiliary reacting portion. The push portion is capable of being pushed to at least a first switch position and a second switch position. A first limit space is formed between the follower portion and the first auxiliary reacting portion, and a second limit space is formed between the follower portion and the second auxiliary reacting portion.

A pair of blades are respectively disposed in the first and second blade compartments, and are respectively limited in the first limit space and the second limit space. Each blade of the pair of blades comprises a first concave portion and a second concave portion, and is capable of being placed in an operative position and a non-operative position.

In this manner, when the push portion of the switch actuator is located in the first switch position thereof, the follower portion pushes against the blade disposed in the first blade compartment moving to the non-operative position thereof so as to allow the first and second concave portions of the blade in the first blade compartment to respectively engage with the pair of first limit portions, and the blade disposed in the second blade compartment is pushed and pressed by the second auxiliary reacting portion to remain in the operative position thereof with the first concave portion thereof engaging with the fixing bulge of the second blade compartment whereby the blade slider is capable of advancing forward from the blade retraction position to the blade protrusion position by pushing the slide actuator so as to simultaneously move the blade in the second blade compartment extending out of the opening. When the push portion of the switch actuator is located in the second switch position thereof, the follower portion pushes against the blade disposed in the second blade compartment to the non-operative position thereof so as to allow the first and second concave portions of the blade in the second blade compartment to respectively engage with the pair of second limit portions, and the blade in the first blade compartment is pushed and pressed by the first auxiliary reacting portion to remain in the operative position thereof with the first concave portion thereof engaging with the fixing bulge of the first blade compartment whereby the blade slider is capable of advancing forward from the blade retraction position to the blade protrusion position by pushing the slide actuator so as to simultaneously move the blade in the first blade compartment extending out of the opening.

The objects and advantages of the present invention are further described in detail in cooperation with accompanying drawings and embodiments as follows.

DETAILED DESCRIPTION OF THE EMBODIMENTS

Figure 1:
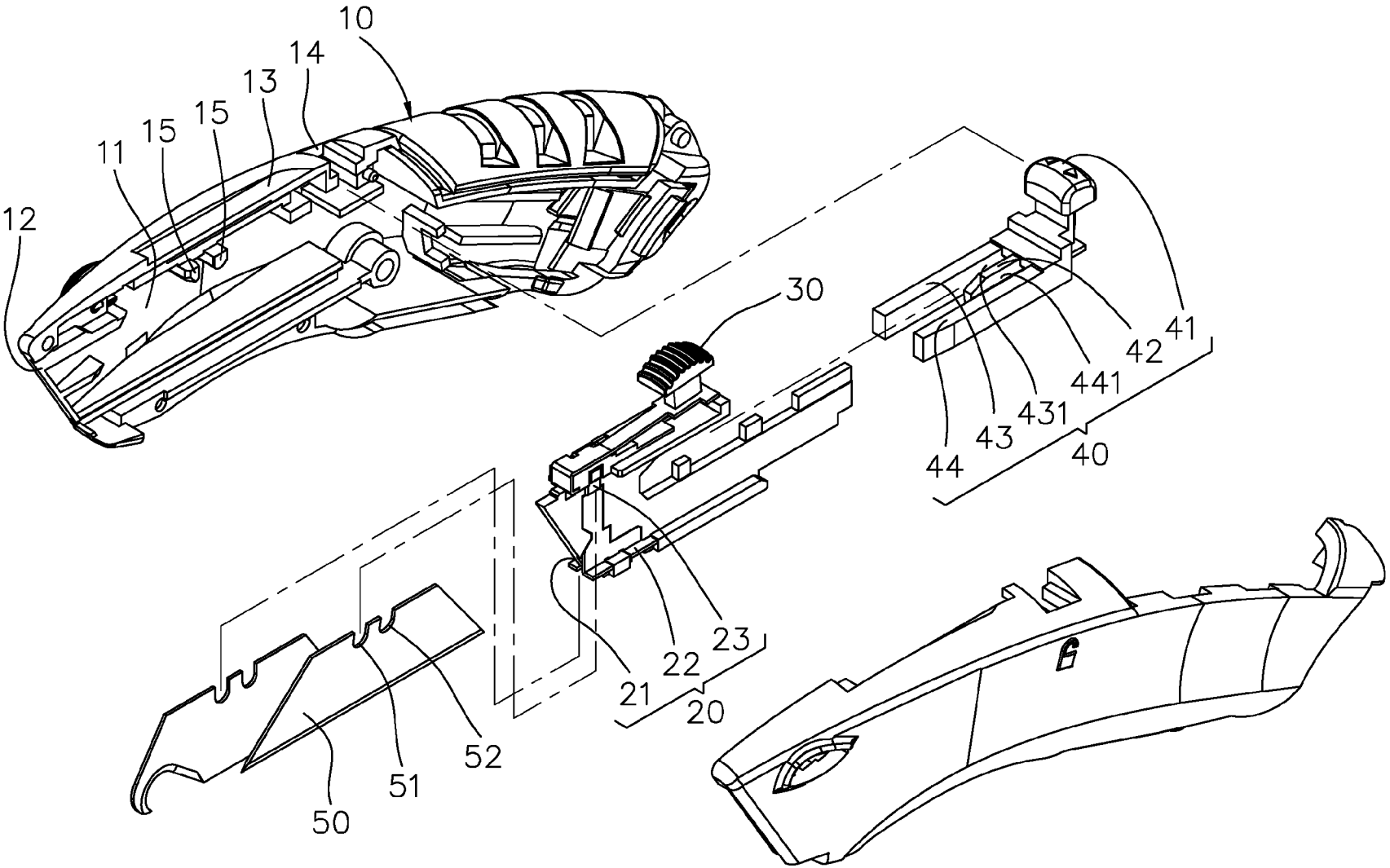
FIG. 1 is a schematic partially exploded perspective view of an improved blade-switchable utility knife of the present invention.
Figure 2:
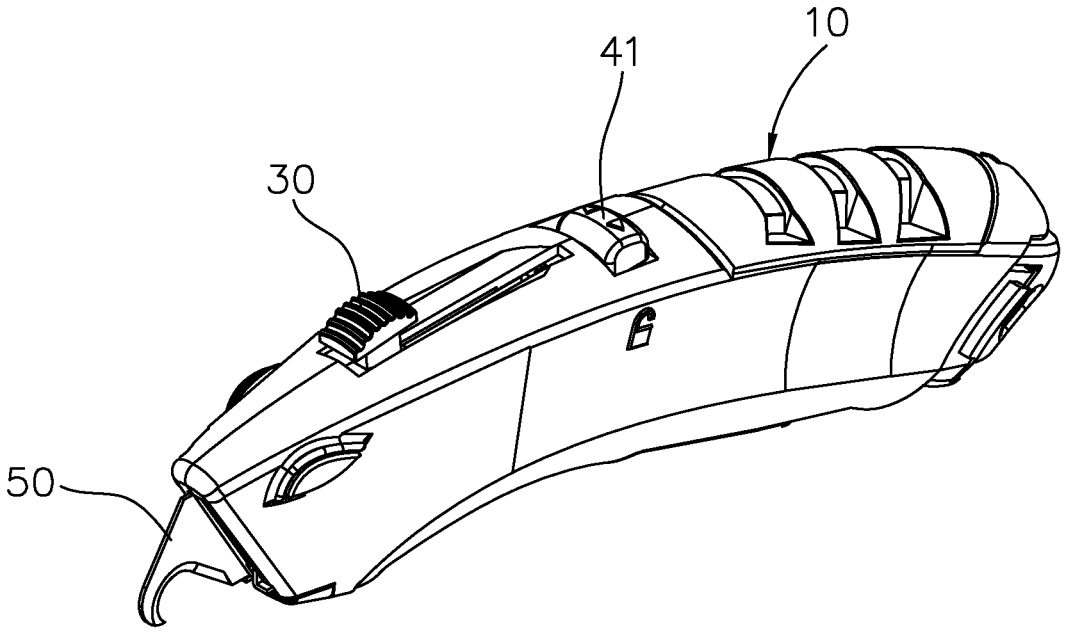
FIG. 2 is an assembled schematic perspective view of FIG. 1.
Figure 3:
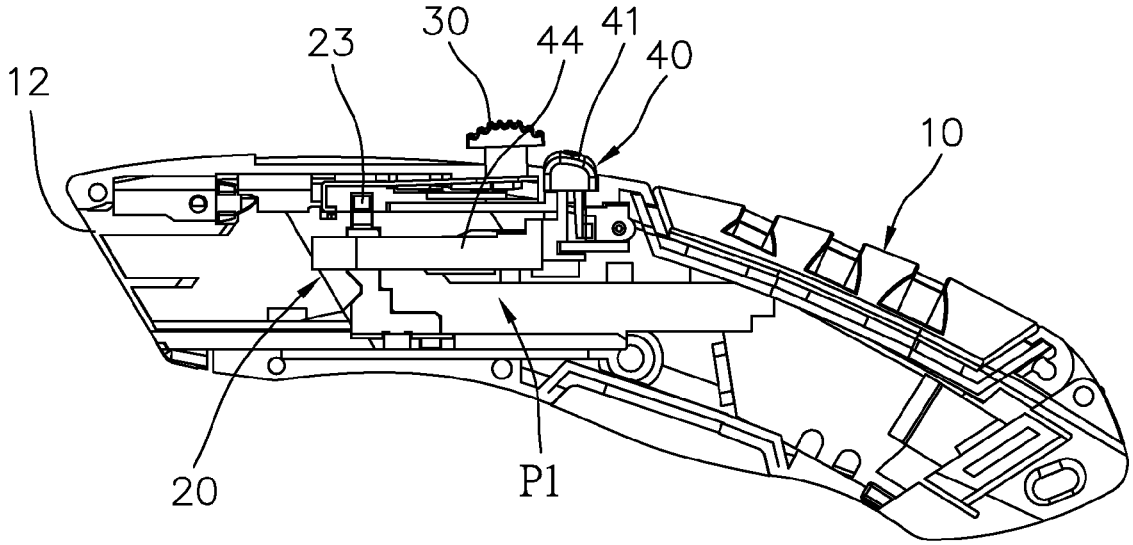
FIG. 3 is a schematic side view showing a blade slider of the present invention in a first moving position thereof inside a housing of the blade-switchable utility knife of the present invention.
Figure 4:
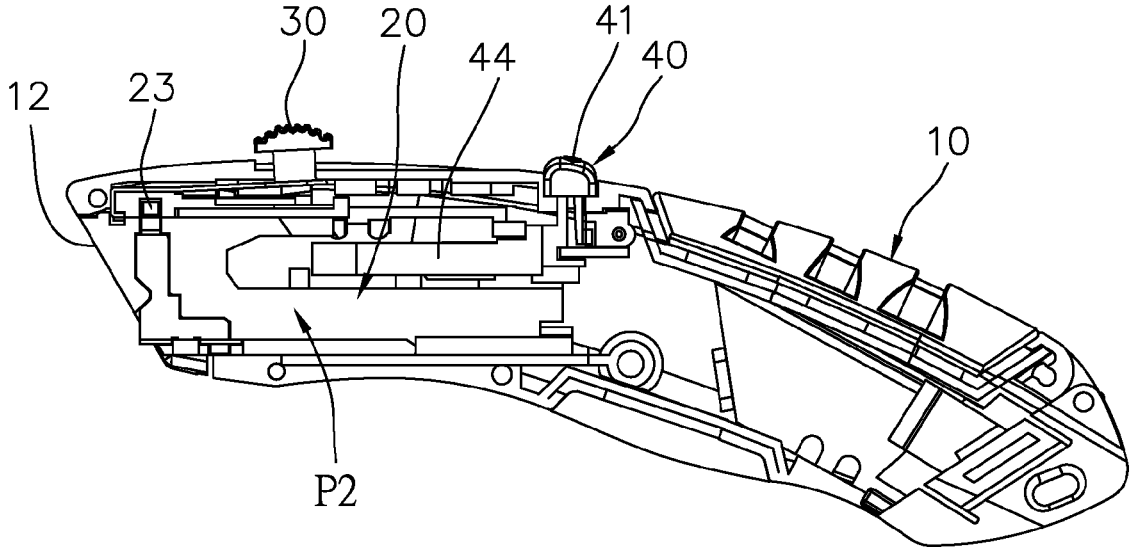
FIG. 4 is a schematic side view showing the blade slider of the present invention in a second moving position thereof inside the housing.

Referring to FIGS. 1 to 6B, a blade-switchable utility knife is provided in accordance with a first embodiment of the present invention. The blade-switchable utility knife comprises a housing 10, a blade slider 20, a slide actuator 30, a switch actuator 40, and a pair of blades 50.

The housing 10 defines an internal space 11 therein, an opening 12 for the blades 50, a sliding slot 13, a switch channel 14, a pair of first limit portions 15 and a pair of second limit portions 16. The switch channel 14 is formed above the housing 10.

The blade slider 20 is received in the internal space 11 of the housing 10 to slidably move backwards and forwards within the internal space 11 and to move to at least a blade retraction position P1 and a blade protrusion position P2. The blade slider 20 comprises a first blade compartment 21 and a second blade compartment 22. A fixing bulge 23 is formed in each of the first and second blade compartments 21, 22. A width of the opening 12 is equal to (or slightly larger than) a width of the blade slider 20 plus a width of the pair of blades 50.

The slide actuator 30 is fixedly disposed on the blade slider 20, and is installed and slidably movable in the sliding slot 13.

The switch actuator 40 is slidably installed in the switch channel 14 and comprises a push portion 41, a follower portion 42, a first auxiliary reacting portion 43 and a second auxiliary reacting portion 44. The push portion 41 is capable of being pushed to at least a first switch position P3 and a second switch position P4. A first limit space 431 is formed between the follower portion 42 and the first auxiliary reacting portion 43. A second limit space 441 is formed between the follower portion 42 and the second auxiliary reacting portion 44. In the first embodiment, the push portion 41 is formed and extended upwardly from the switch actuator 40 so as to slide in the switch channel 14 along a left-to-right direction.

The pair of blades 50 are respectively disposed in the first and second blade compartments 21, 22, and are respectively limited in the first and second limit spaces 431, 441. Each blade of the pair of blades 50 comprises a first concave portion 51 and a second concave portion 52, and is capable of being placed in an operative position P5 and a non-operative position P6.

In this manner, when the push portion 41 of the switch actuator 40 is located in the first switch position P3 thereof, the follower portion 42 pushes against the blade 50 disposed in the first blade compartment 21 to move it to the non-operative position P6 thereof so as to allow the first and second concave portions 51, 52 of the blade 50 in the first blade compartment 21 to respectively engage with the pair of first limit portions 15. Meanwhile, the blade 50 disposed in the second blade compartment 22 is pushed and pressed by the second auxiliary reacting portion 44 to remain in the operative position P5 thereof with the first concave portion 51 thereof engaging with the fixing bulge 23 of the second blade compartment 22. At this moment, the blade slider 20 is capable of advancing forward from the blade retraction position P1 to the blade protrusion position P2 by pushing the slide actuator 30 so as to simultaneously move the blade 50 in the second blade compartment 22 extending out of the opening 12. Alternatively, when the push portion 41 of the switch actuator 40 is located in the second switch position P4 thereof, the follower portion 42 pushes against the blade 50 disposed in the second blade compartment 22 to the non-operative position P6 thereof so as to allow the first and second concave portions 51, 52 of the blade 50 in the second blade compartment 22 to respectively engage with the pair of second limit portions 16. The blade 50 in the first blade compartment 21 is then pushed and pressed by the first auxiliary reacting portion 43 to remain in the operative position P5 thereof with the first concave portion 51 thereof engaging with the fixing bulge 23 of the first blade compartment 21. At this moment, the blade slider 20 is capable of advancing forward from the blade retraction position P1 to the blade protrusion position P2 by pushing the slide actuator 30 so as to simultaneously move the blade 50 in the first blade compartment 21 extending out of the opening 12.

Figure 5:
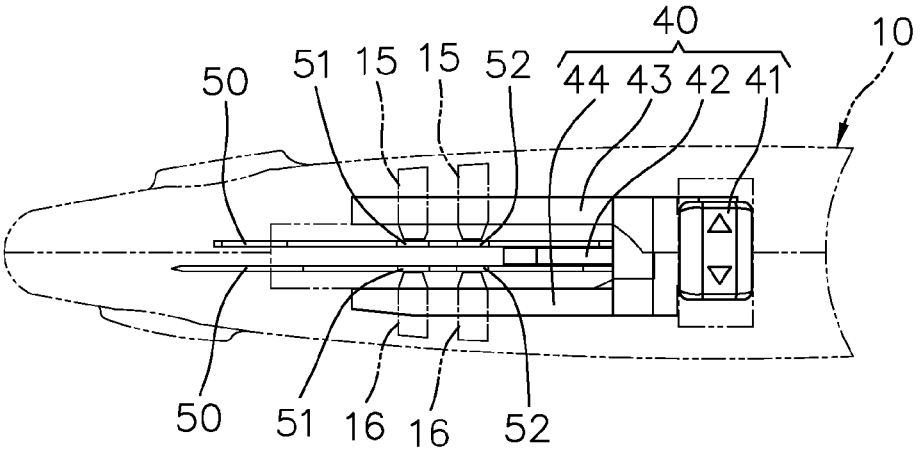
FIG. 5 is a schematic partial top plan view of the blade-switchable utility knife of the present invention.
Figure 6A:
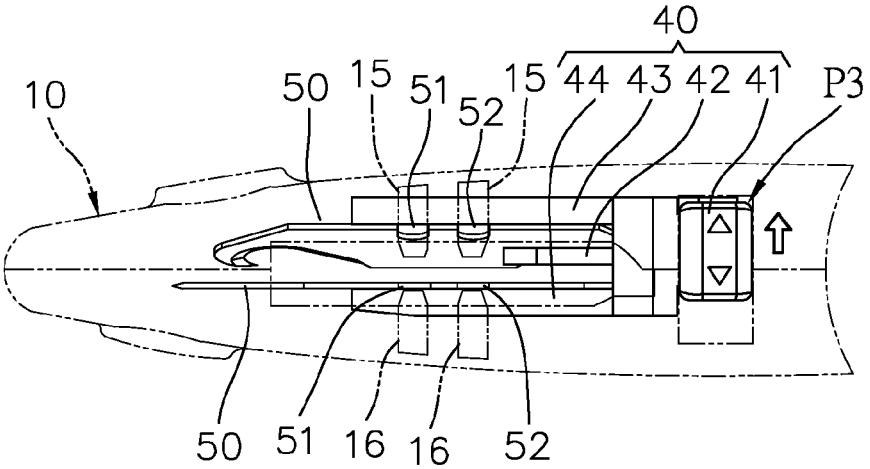
FIG. 6A is a schematic partial top plan view showing a switch actuator of the blade-switchable utility knife of the present invention in a first switch position thereof.
Figure 6B:
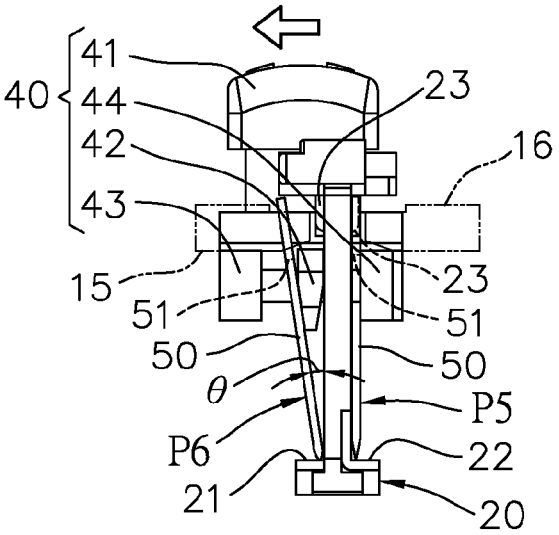
FIG. 6B is a schematic partial front elevational view of FIG. 6A.
Figure 7A:
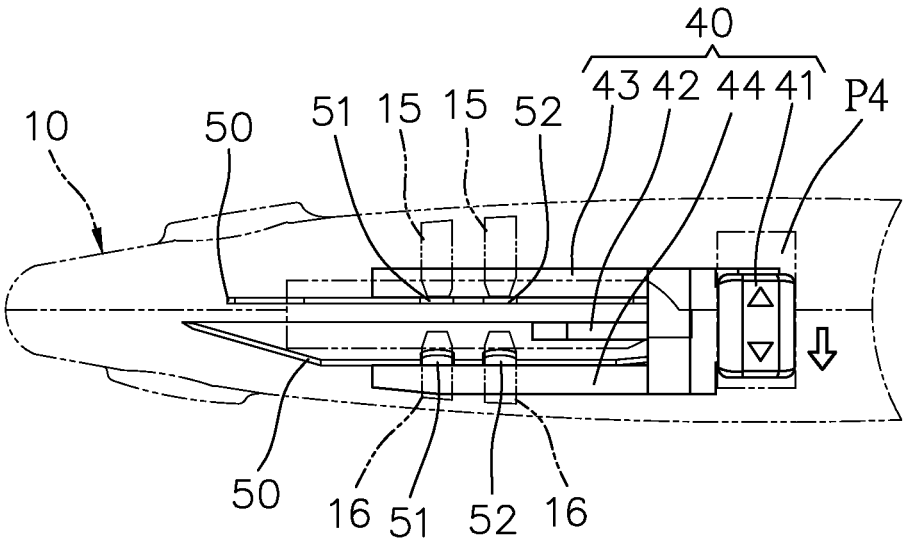
FIG. 7A is a schematic partial top plan view showing the switch actuator of the blade-switchable utility knife of the present invention in a second switch position thereof.
Figure 7B:
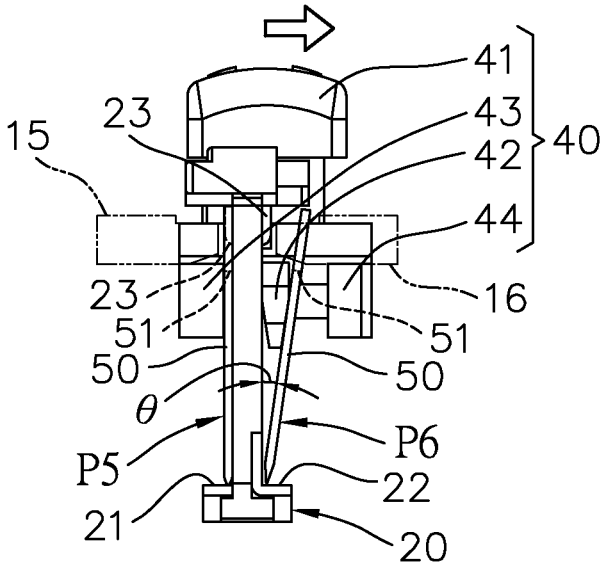
FIG. 7B is a schematic partial front elevational view of FIG. 7A.

As shown in FIG. 5, the pairs of first and second limit portions 15, 16 are respectively disposed at two opposite sides of the housing 10. As shown in FIGS. 6A and 6B, when the push portion 41 moves to the first switch position P3 thereof, the follower portion 42 pushes against the blade 50 received in the first blade compartment 21 to the non-operative position P6 thereof so that the blade 50 inclines at a predetermined angle θ relative to a central wall of the blade slider 20, and the first and second concave portions 51, 52 respectively engage with the pair of the first limit portions 15. The blade 50 in the second blade compartment 22 is pushed and pressed by the second auxiliary reacting portion 44 to remain in the operative position P5 thereof. As show in FIGS. 7A and 7B, when the push portion 41 moves to the second switch position P4 thereof, the follower portion 42 pushes against the blade 50 received in the second blade compartment 22 to the non-operative position P6 thereof so that to the blade 50 inclines at a predetermined angle of θ relative to the central wall of the blade slider 20, and the first and second concave portions 51, 52 respectively engage with the pair of the first limit portions 15. The blade 50 in the second blade compartment 22 is pushed and pressed by the second auxiliary reacting portion 44 to remain in the operative position P5 thereof.

Accordingly, the present invention utilizes position switch of the push portion 41 to limit the blade 50 either in the first blade compartment 21 or the second blade compartment 22 onto either one of the pairs of the first and second limit portions 15, 16 thereof. When the slide actuator 30 is pushed to move the blade slider 20 from the blade retraction position P1 to the blade protrusion position P2, the blade 50 engaged and limited by either one of the pairs of the first and second limit portions 15, 16 is unable to move together with the blade slider 20 while the blade 50 engaged with the fixing bulge 23 is able to move together with the blade slider 20 and protrudes out of the opening 12.

Figure 8A:
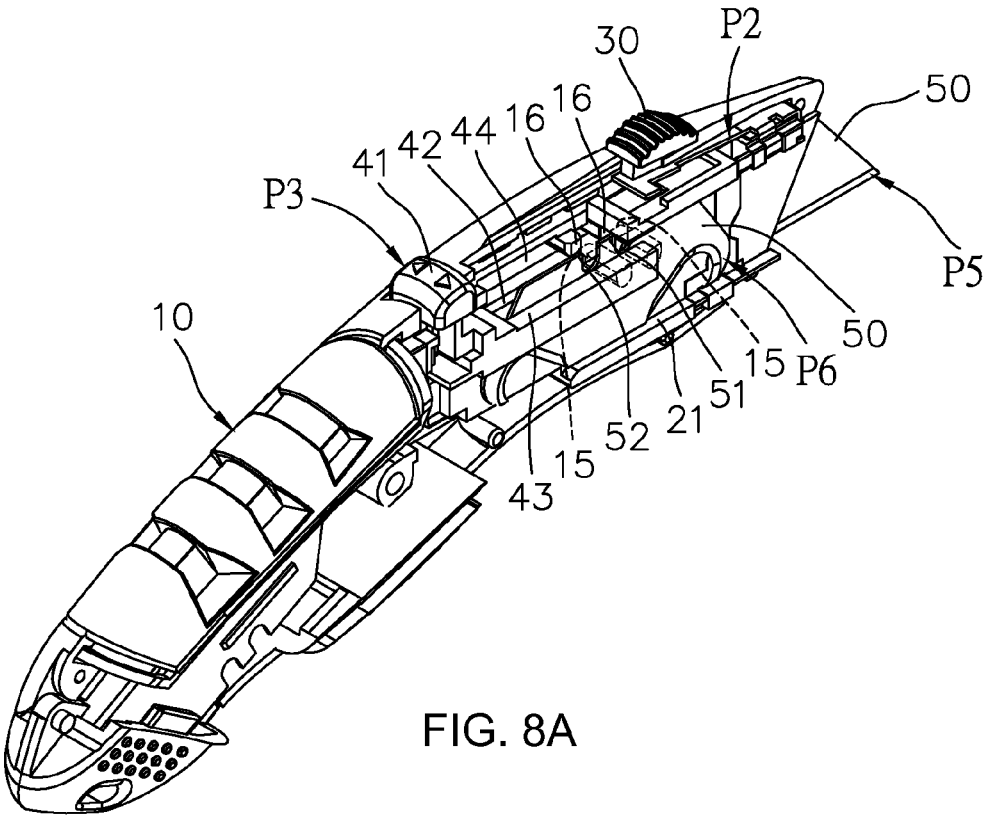
FIG. 8A is a schematic perspective view showing a first blade of the blade-switchable utility knife of the present invention protruding out of the housing for use when the switch actuator is in the first switch position thereof.
Figure 8B:
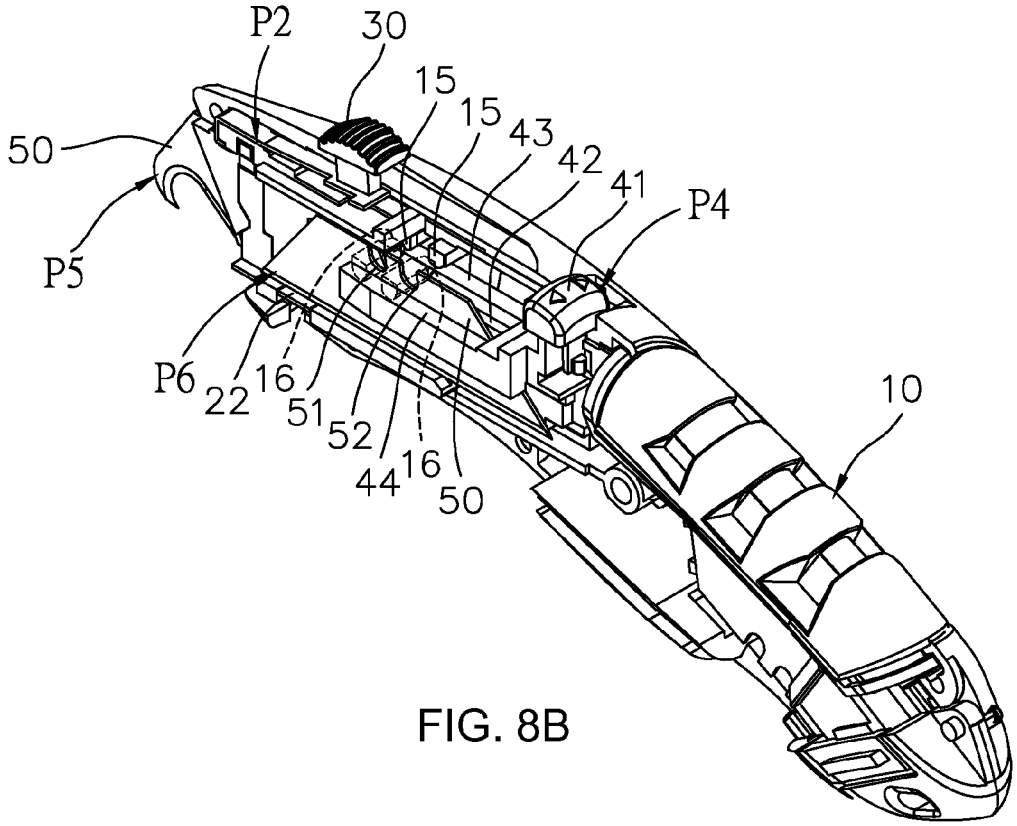
FIG. 8B is a schematic perspective view showing a second blade of the blade-switchable utility knife of the present invention protruding out of the housing for use when the switch actuator is in the second switch position thereof.

Referring to FIG. 8A, when the push portion 41 is located in the first switch position P3, the blade 50 in the first blade compartment 21 is limited by the pair of the first limit portions 15. In such circumstances, pushing the slide actuator 30 forwards enables the blade 50 in the second blade compartment 22 to protrude out of the opening 12. Referring to FIG. 8B, when the push portion 41 is located in the second switch position P4, the blade 50 in the second blade compartment 22 is limited by the pair of the second limit portions 16. In such circumstances, pushing the slide actuator 30 forwards enables the blade 50 in the first blade compartment 21 to protrude out of the opening 12.

As understood from the above explanations, the first and second blade compartments 21, 22 of the present invention can be equipped with the two blades 50, respectively. The two blades 50 can be of different specifications, functions, or shapes. Users can switch the blades 50 as required at any time during working processes. Certainly, the first and second blade compartments 21, 22 can also be equipped with two blades of the same specification. When one of the blades 50 is damaged, users can directly switch to another blade 50 for use and continue working.

Figure 9:
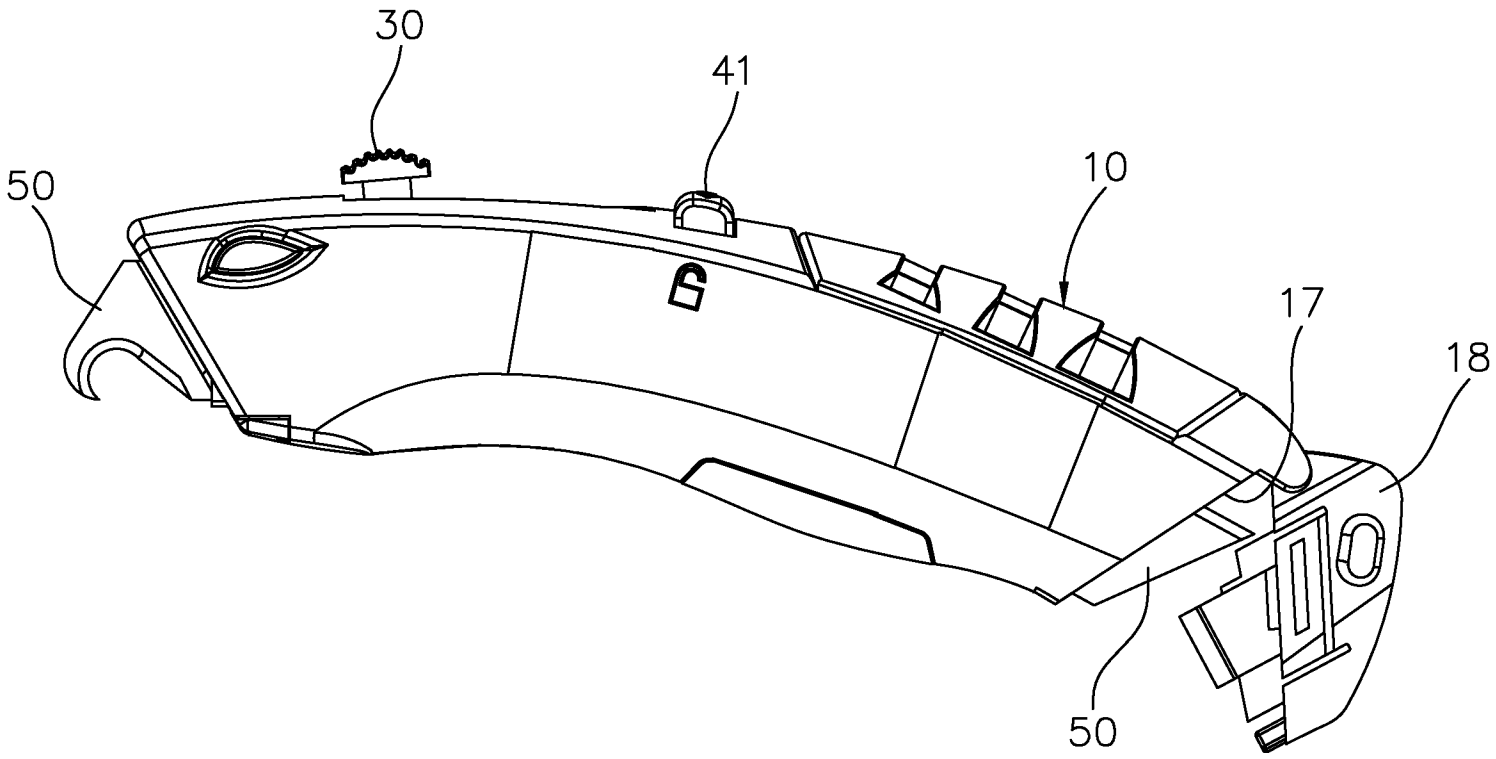
FIG. 9 is a schematic side view of the blade-switchable utility knife of the present invention showing a storage space thereof.

Referring to FIG. 9, the housing 10 of the present invention further comprises a storage space 17 and a movable cover 18. The storage space 17 can be used to store a plurality of spare blades 50 therein, and the movable cover 18 is disposed at an opening of the storage space 17 for opening or closing the storage space 17.

Figure 10:
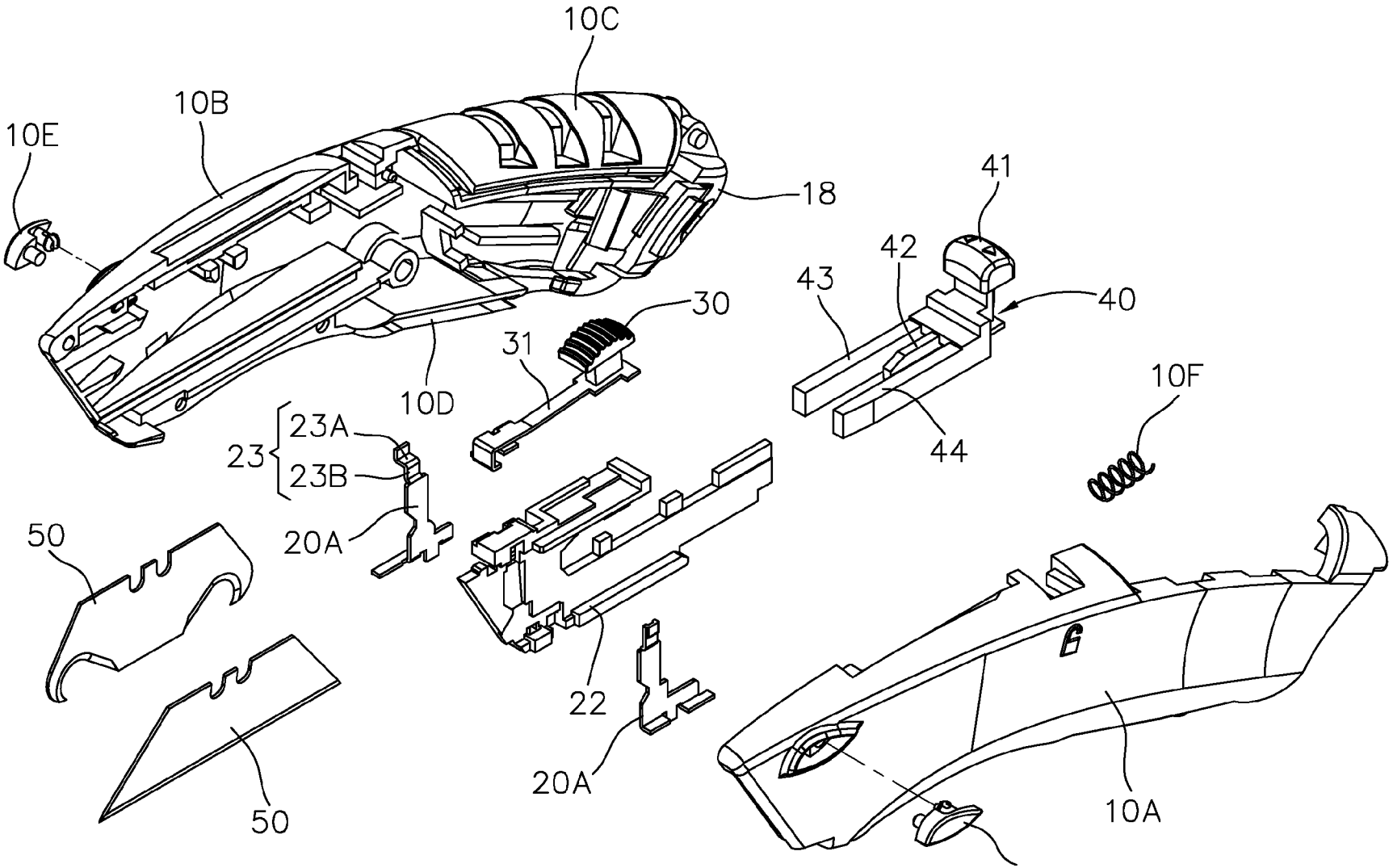
FIG. 10 is a schematic exploded view of the blade-switchable utility knife of the present invention showing parts thereof in detail.

Referring to FIG. 10, a schematic exploded view of the housing 10 of the blade-switchable utility knife of the present invention is shown. The housing 10 comprises a right casing 10A, a left casing 10B, a top casing 10C, a bottom casing 10D, two pushing elements 10E, a resilient element 10F, and the movable cover 18. The resilient element 10F utilizes its resilient force to maintain the movable cover 18 in a position to close the storage space 17. The blade slider 20 comprises two fixing resilient plates 20A respectively fixed to the first and second blade compartments 21, 22. The fixing resilient plates 20A extend out to form the fixing bulges 23. The slide actuator 30 comprises a fixing buckle 31 for buckling the slide actuator 30 onto the blade slider 20.

In addition, as shown in FIG. 10, each of the fixing bulges 23 comprises an engaging section 23A and a pressing section 23B. The engaging sections 23A are used to engage with the first concave portions 51 of the blades 50, and the pressing sections 23B correspond to pushing positions of the pushing elements 10E. When the pushing elements 10E are pressed to push the pressing sections 23B, the fixing resilient plates 20A accordingly bend toward a middle of the blade slider 20 so as to disengage corresponding first concave portions 51 of the blades 50 from the fixing bulges 23, and thus to dismantle the blades 50 for blade replacement or change of cutting blade sides (i.e., changing blade orientation of the dismantled blades 50 and assembling the blades 50 back to the blade-switchable utility knife via engagement between the second concave portions 52 and the fixing bulges 23, and continuing cutting by use of the other cutting blade sides of the blades 50).

Figure 11:
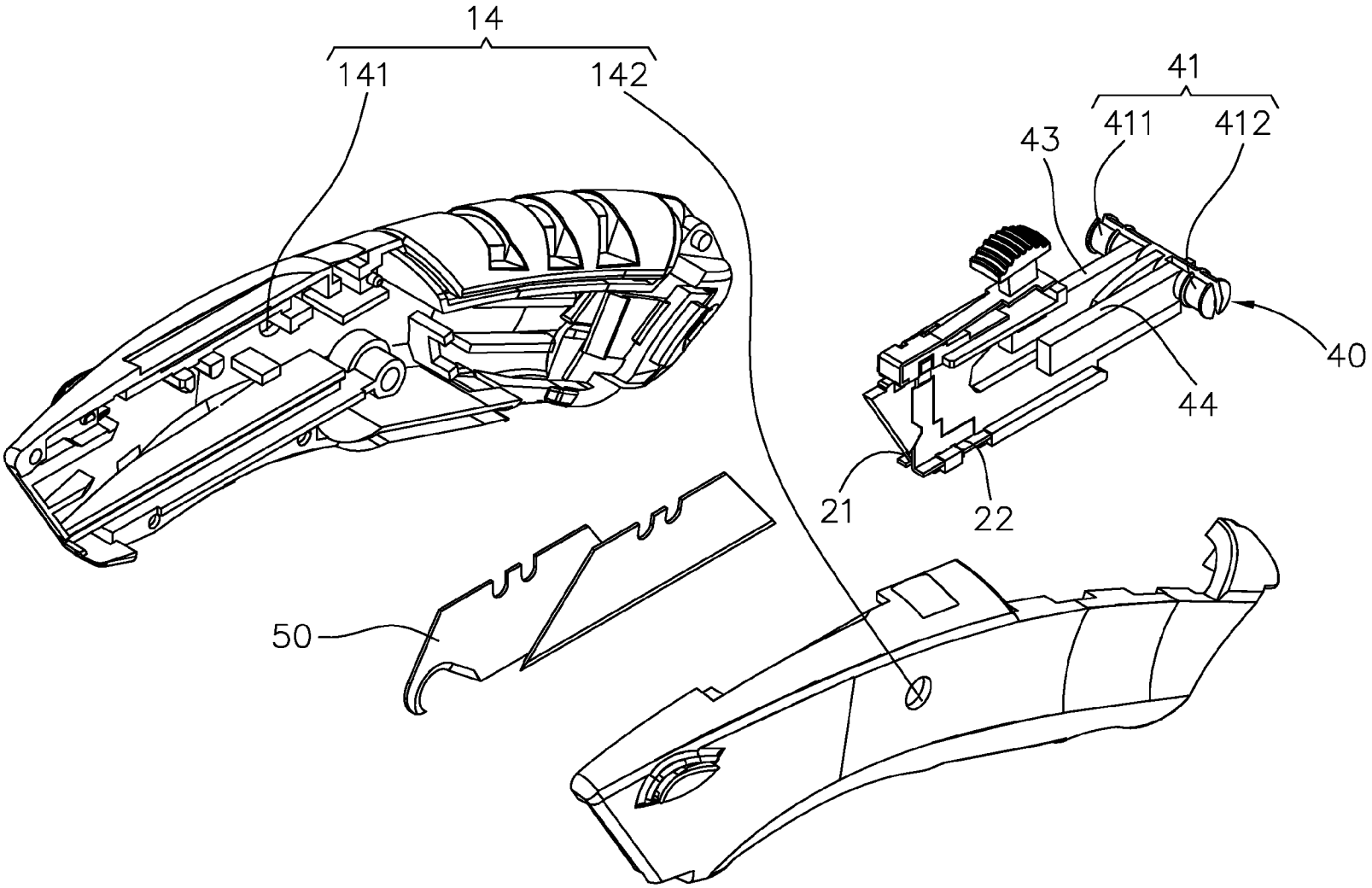
FIG. 11 is a schematic partially exploded perspective view of a second embodiment of the blade-switchable utility knife of the present invention.
Figure 12:
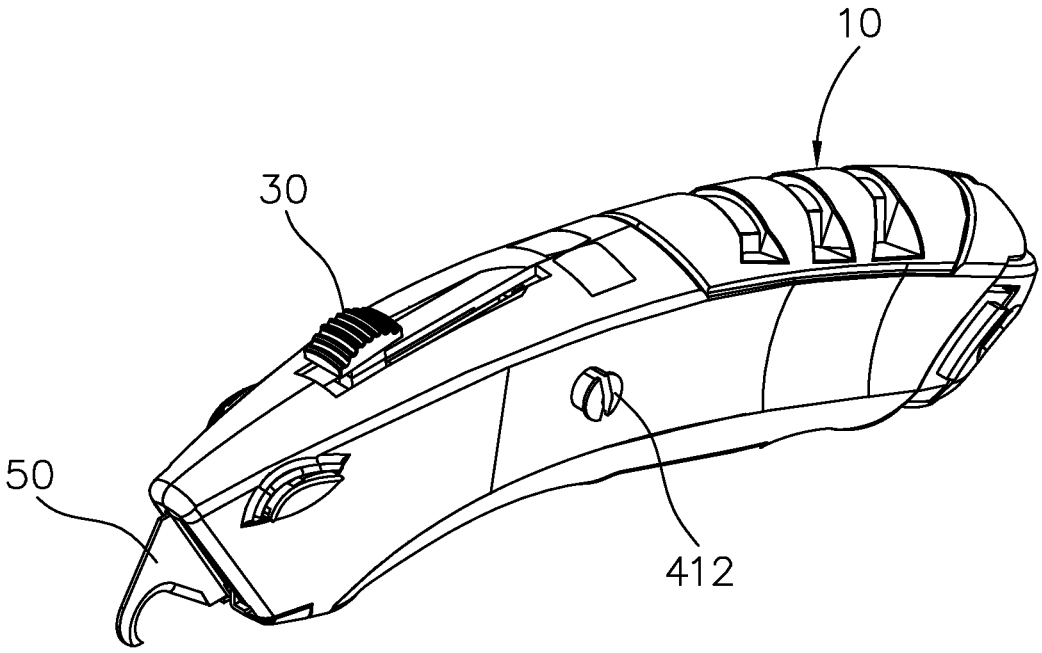
FIG. 12 is an assembled schematic perspective view of FIG. 11.
Figure 13A:
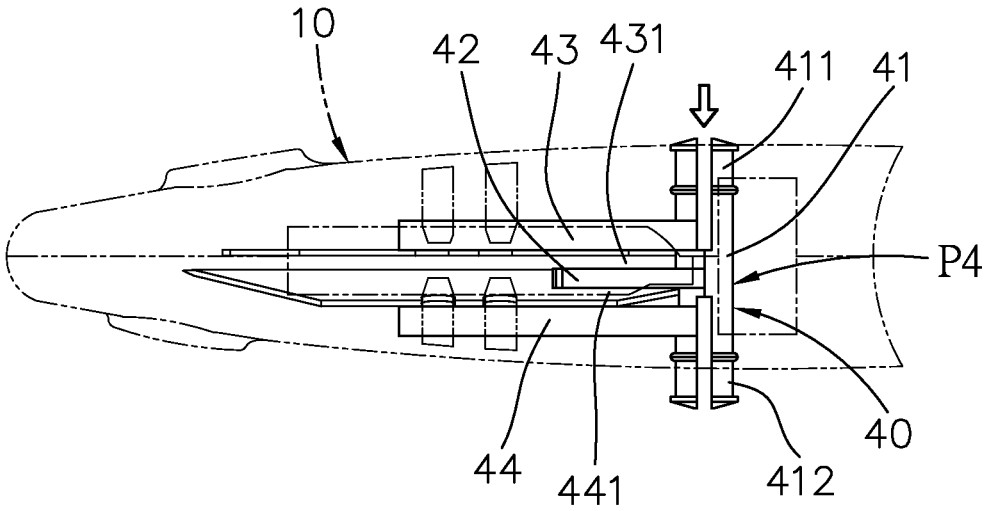
FIG. 13A is a schematic partial front elevational view showing the second embodiment of the blade-switchable utility knife of the present invention in a second switch position thereof.
Figure 13B:
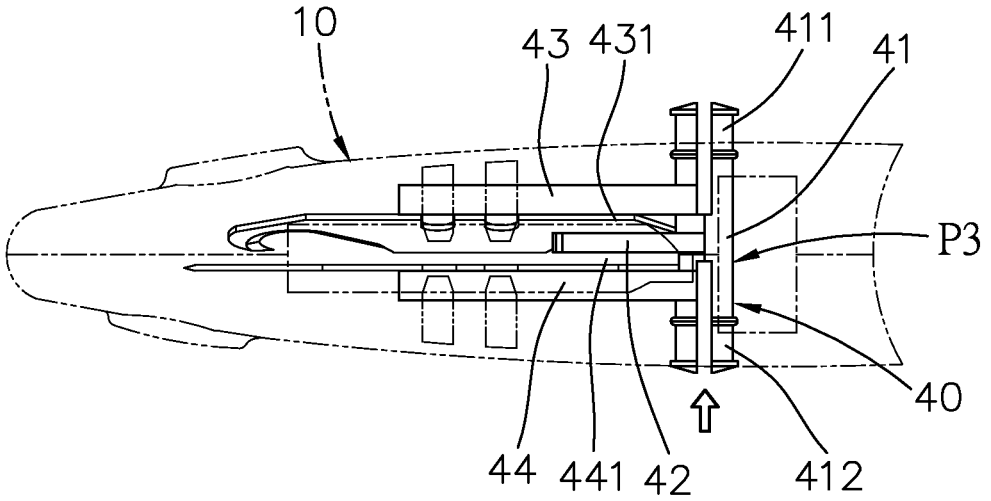
FIG. 13B is a schematic partial front elevational view showing the second embodiment of the blade-switchable utility knife of the present invention in a first switch position thereof.

Referring to FIG. 11 and FIG. 12, another blade-switchable utility knife is shown in according to a second embodiment of the present invention. The switch channel 14 penetrates through two opposite sides of the housing 10 to form a first switch hole 141 and a second switch hole 142, respectively. The push portion 41 extends outwardly from two opposite sides of the switch actuator 40 to form a first push block 411 and a second push block 412. The first and second push blocks 411, 412 are movable at the first and second switch holes 141, 142, respectively. Referring to FIG. 13A and FIG. 13B, pressing one of the first push block 411 and the second push block 412 enables the push portion 41 to switch to a corresponding one of the second switch position P4 and the first switch position P3, respectively. As a result, the purpose of switching the blades 50 can be achieved.

Figure 14:
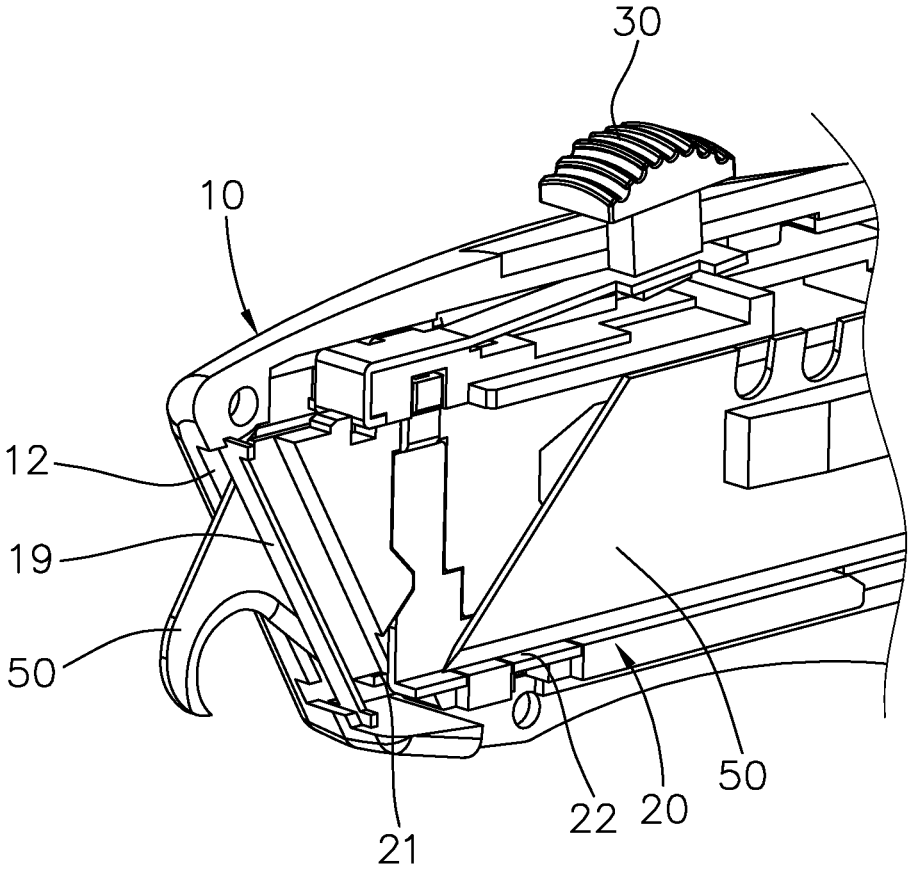
FIG. 14 is a schematic partial perspective view showing a baffle plate of the blade-switchable utility knife of the present invention.

As shown in FIG. 14, in design, the housing 10 of the blade-switchable utility knife of the present invention further comprises a baffle plate 19. The baffle plate 19 is disposed at a central location of the opening 12 to enable the blade 50 disposed in the first blade compartment 21 and the blade 50 in the second blade compartment 22 to respectively extend out of the opening 12 from two opposite sides of the baffle plate 19.

To sum up, advantages and effects of the present invention can be concluded as following.

[1] Quick switch of blades for use: Conventional utility knifes are equipped with only one blade for use. When the blade becomes worn out and dull or different blades are in need, it is necessary to detach and replace the originally installed blade and is rather inconvenient for use. On the contrary, the blade-switchable utility knife of the present invention is capable of being equipped with two blades, and the blades 50 can be selectively switched by a switch actuator 40 based on requirements. Accordingly, the present invention has advantages of ability to switch blades.

[2] Convenient carrying: Conventionally, when continuously and alternately using different types of blades is necessary for accomplishment of a particular working content, multiple utility knifes will generally be prepared to perform such working content. However, such way causes problems of inconvenient carrying and consumption of costs, etc. On the contrary, the present invention utilizes blade switch to alternately use different blades based on different working contents. Accordingly, it is no need to carry two utility knifes and thus the present invention has advantages of convenient carrying.

The above mentioned is only exemplary embodiments of the present invention. As in detailed explanations as above, the present invention is proved to be understandable and the above mentioned inventive purpose is proved to be achievable by persons of ordinary skill in this art field. It should be noted, for persons of ordinary skill in this art field, improvements and modifications within the spirit of the present invention can be further made, and such improvements and modifications should be seemed to be included in the claimed scope of the present invention.

What is claimed is:

1. A blade-switchable utility knife, comprising:

a housing defining an internal space therein, an opening, a sliding slot, a switch channel, a pair of first limit portions and a pair of second limit portions;

a blade slider received in the internal space of the housing to slidably move backwards and forwards within the internal space and to move to at least a blade retraction position and a blade protrusion position, the blade slider comprising a first blade compartment and a second blade compartment, a fixing bulge formed in each of the first and second blade compartments;

a slide actuator fixedly disposed on the blade slider, and installed and slidably movable in the sliding slot;

a switch actuator slidably installed in the switch channel and comprising a push portion, a follower portion, a first auxiliary reacting portion and a second auxiliary reacting portion, the push portion capable of being pushed to at least a first switch position and a second switch position, a first limit space formed between the follower portion and the first auxiliary reacting portion, a second limit space formed between the follower portion and the second auxiliary reacting portion; and a pair of blades respectively disposed in the first and second blade compartments and respectively limited in the first limit space and the second limit space, each blade of the pair of blades comprising a first concave portion and a second concave portion and being capable of being placed in an operative position and a non-operative position;

wherein when the push portion of the switch actuator is located in the first switch position thereof, the follower portion pushes against the blade disposed in the first blade compartment moving to the non-operative position thereof so as to allow the first and second concave portions of the blade in the first blade compartment to respectively engage with the pair of first limit portions, and the blade disposed in the second blade compartment is pushed and pressed by the second auxiliary reacting portion to remain in the operative position thereof with the first concave portion thereof engaging with the fixing bulge of the second blade compartment whereby the blade slider is capable of advancing forward from the blade retraction position to the blade protrusion position by pushing the slide actuator so as to simultaneously move the blade in the second blade compartment extending out of the opening, and when the push portion of the switch actuator is located in the second switch position thereof, the follower portion pushes against the blade disposed in the second blade compartment to the non-operative position thereof so as to allow the first and second concave portions of the blade in the second blade compartment to respectively engage with the pair of second limit portions, and the blade in the first blade compartment is pushed and pressed by the first auxiliary reacting portion to remain in the operative position thereof with the first concave portion thereof engaging with the fixing bulge of the first blade compartment whereby the blade slider is capable of advancing forward from the blade retraction position to the blade protrusion position by pushing the slide actuator so as to simultaneously move the blade in the first blade compartment extending out of the opening.

2. The blade-switchable utility knife as claimed in claim 1, wherein the housing further comprises a storage space and a movable cover, the storage space is used for storing blades therein, and the movable cover is disposed at an opening of the storage space for opening or closing the storage space.

3. The blade-switchable utility knife as claimed in claim 1, wherein the switch channel is formed above the housing, the push portion is formed and extended upwardly from the switch actuator so as to slide in the switch channel along a left-to-right direction.

4. The blade-switchable utility knife as claimed in claim 1, wherein the switch channel penetrates through two opposite sides of the housing to form a first switch hole and a second switch hole, respectively, the push portion extends outwardly from two opposite sides of the switch actuator to form a first push block and a second push block, the first and second push blocks are respectively movable at the first and second switch holes.

5. The blade-switchable utility knife as claimed in claim 1, wherein the housing further comprises a baffle plate which is disposed at a central location of the opening to enable the blade disposed in the first blade compartment and the blade disposed in the second blade compartment to respectively extend out of the opening from two opposite sides of the baffle plate.

* * * * *